US011598048B2

(12) United States Patent
Nam

(10) Patent No.: US 11,598,048 B2
(45) Date of Patent: Mar. 7, 2023

(54) WATER-REPELLENT FABRIC AND WATER-REPELLENT DOWN PRODUCT COMPRISING THE SAME

(71) Applicant: DELIGHTS & GLOBAL CO., LTD., Seoul (KR)

(72) Inventor: Myoung Hun Nam, Seoul (KR)

(73) Assignee: DELIGHTS & GLOBAL CO., LTD., Seoul (KR)

( * ) Notice: Subject to any disclaimer, the term of this patent is extended or adjusted under 35 U.S.C. 154(b) by 899 days.

(21) Appl. No.: 16/477,529

(22) PCT Filed: Jan. 24, 2018

(86) PCT No.: PCT/KR2018/001062
§ 371 (c)(1),
(2) Date: Jul. 12, 2019

(87) PCT Pub. No.: WO2018/139849
PCT Pub. Date: Aug. 2, 2018

(65) Prior Publication Data

US 2019/0352842 A1 Nov. 21, 2019

(30) Foreign Application Priority Data

Jan. 24, 2017 (KR) ..... 10-2017-0010815
Nov. 23, 2017 (KR) ..... 10-2017-0157141

(51) Int. Cl.
*B05D 1/18* (2006.01)
*D06M 15/564* (2006.01)
(Continued)

(52) U.S. Cl.
CPC ..... *D06M 15/564* (2013.01); *A41D 31/102* (2019.02); *D06M 15/248* (2013.01);
(Continued)

(58) Field of Classification Search
CPC .... B05D 1/18; D06M 15/564; D06M 15/248; D06M 15/653; D06M 2101/38; D06M 2200/10
See application file for complete search history.

(56) References Cited

U.S. PATENT DOCUMENTS

2018/0215848 A1† 8/2018 Hosoda
2019/0375897 A1* 12/2019 Gotou ..... D06M 13/507

FOREIGN PATENT DOCUMENTS

JP 09-143364 A 6/1997
JP 2004256800 A * 9/2004
(Continued)

OTHER PUBLICATIONS

Espacenet translation of JP-2015165056-A. (Year: 2015).*
(Continued)

*Primary Examiner* — Hai Y Zhang
(74) *Attorney, Agent, or Firm* — Revolution IP, PLLC

(57) ABSTRACT

A method of preparing a water-repellent and moisture-permeable fabric, includes: preparing a water-repellent fabric by: immersing a raw fabric in a non-fluorinated water-repellent emulsion containing a non-fluorinated water repellent and an aqueous blocked polyisocyanate crosslinking agent; and drying and curing the raw fabric, which has been immersed, at a temperature of 150° C. to 200° C.; applying a polyurethane-based moisture-permeable coating liquid to the water-repellent fabric; and drying the water-repellent fabric while increasing a temperature from 100° C. to 150° C.

5 Claims, 5 Drawing Sheets

(51) Int. Cl.

| | |
|---|---|
| ***A41D 31/102*** | (2019.01) |
| ***D06M 15/653*** | (2006.01) |
| ***D06M 15/248*** | (2006.01) |
| *D06M 101/38* | (2006.01) |

(52) U.S. Cl.
CPC ..... *D06M 15/653* (2013.01); *A41D 2500/54* (2013.01); *D06M 2101/38* (2013.01); *D06M 2200/10* (2013.01); *D10B 2331/10* (2013.01); *D10B 2401/021* (2013.01)

(56) References Cited

FOREIGN PATENT DOCUMENTS

| | | | |
|---|---|---|---|
| JP | 2015165056 A | * | 9/2015 |
| JP | 2017145521 A | * | 8/2017 |
| KR | 10-1437399 B1 | | 11/2014 |
| KR | 10-2016-0076526 A | | 6/2016 |
| KR | 10-2016-0081474 A | | 7/2016 |
| KR | 10-2016-0110947 A | | 9/2016 |

OTHER PUBLICATIONS

Espacenet translation of JP-2004256800-A. (Year: 2004).*
JP-2017145521-A with English translation. (Year: 2022).*
JP-2004256800-A with English translation (Year: 2022).*
JP-2015165056-A with English translation (Year: 2022).*
JP-2004256800-A English translation. (Year: 2022).*
JP-2015165056-A English translation. (Year: 2022).*
International Search Report for PCT/KR2018/001062 dated May 2, 2018 from Korean Intellectual Property Office.

* cited by examiner
† cited by third party

[FIG. 1]
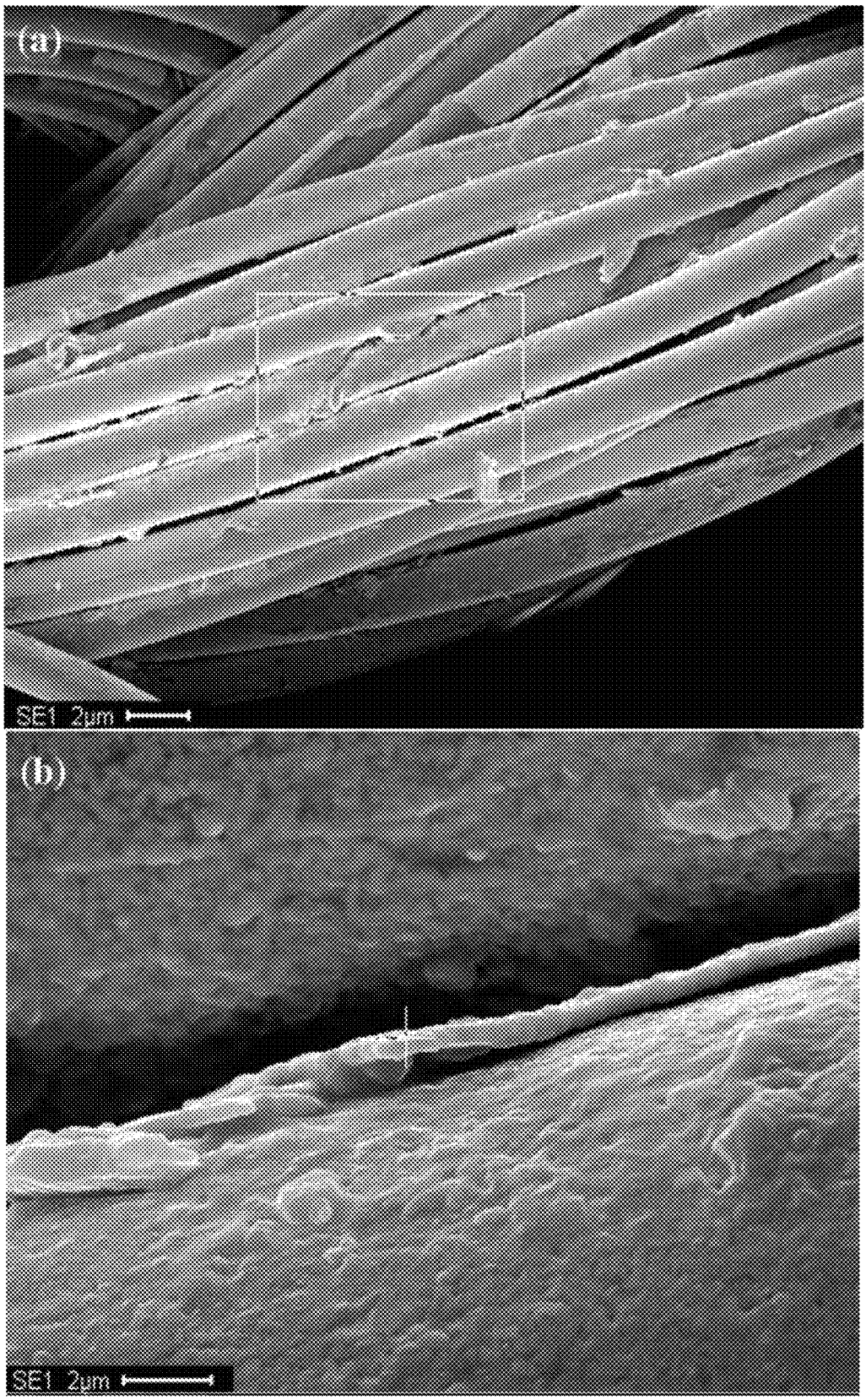

[FIG. 2]
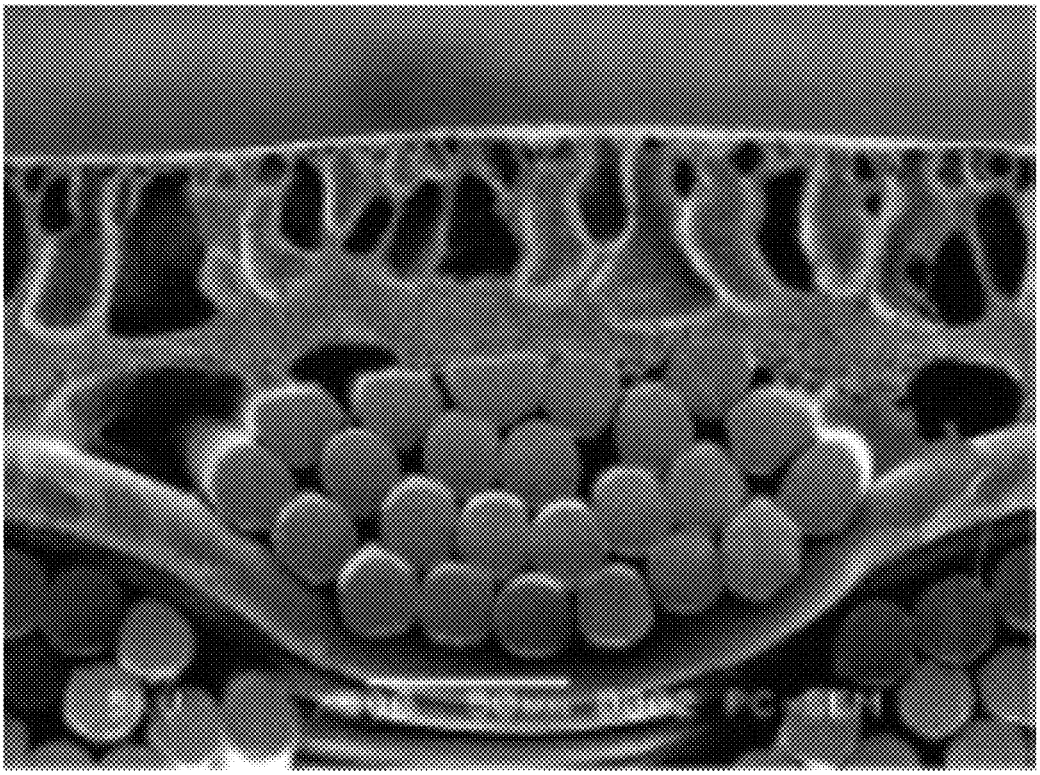
[FIG. 3]
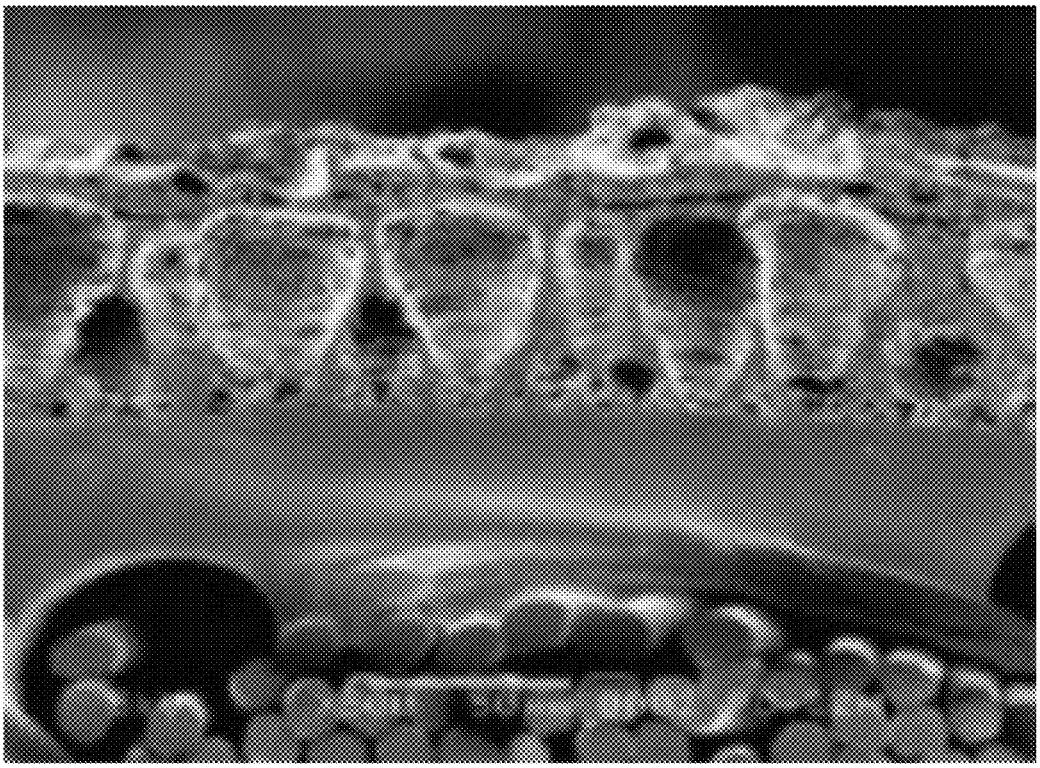

[FIG. 4]
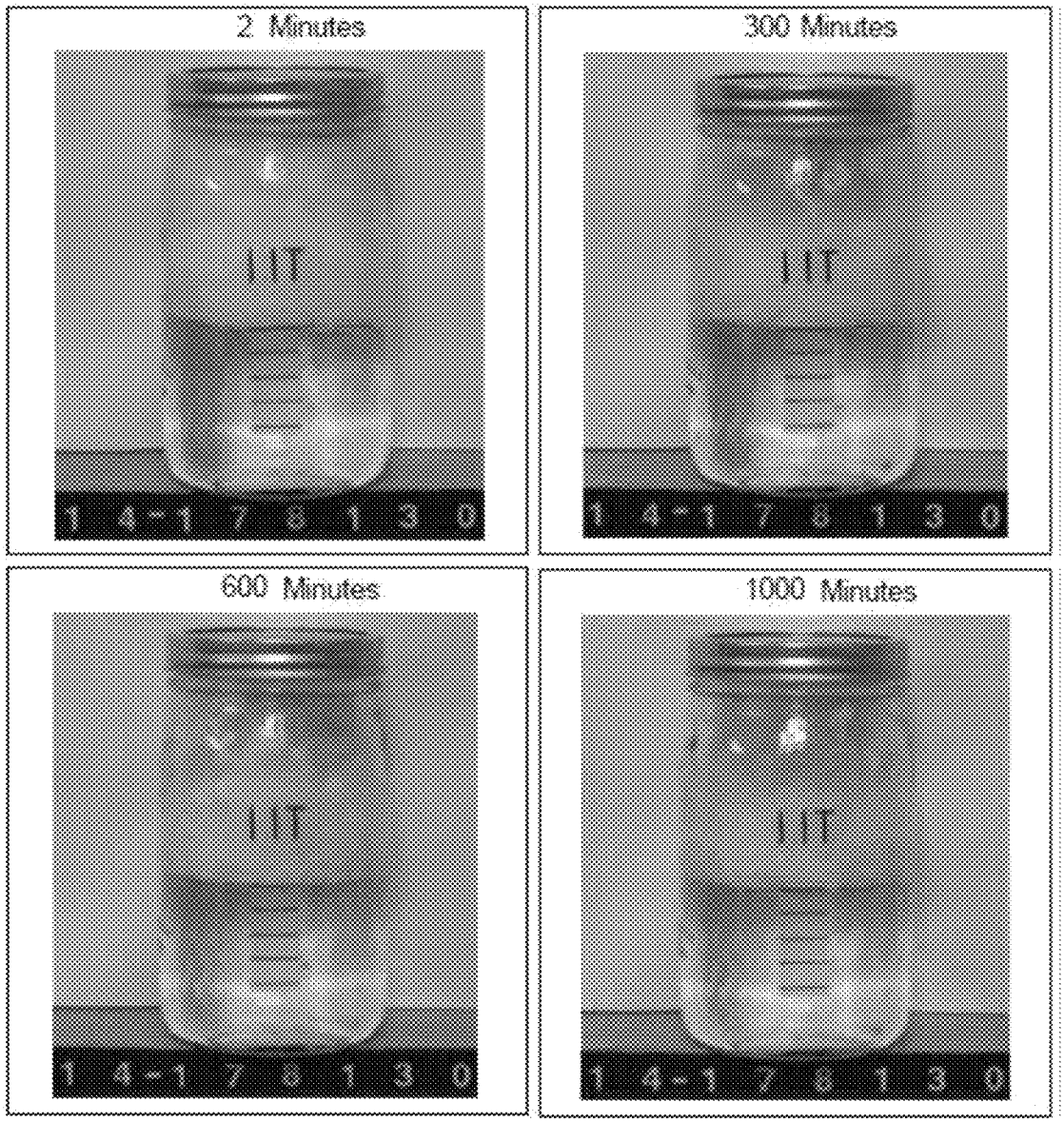

[FIG. 5]
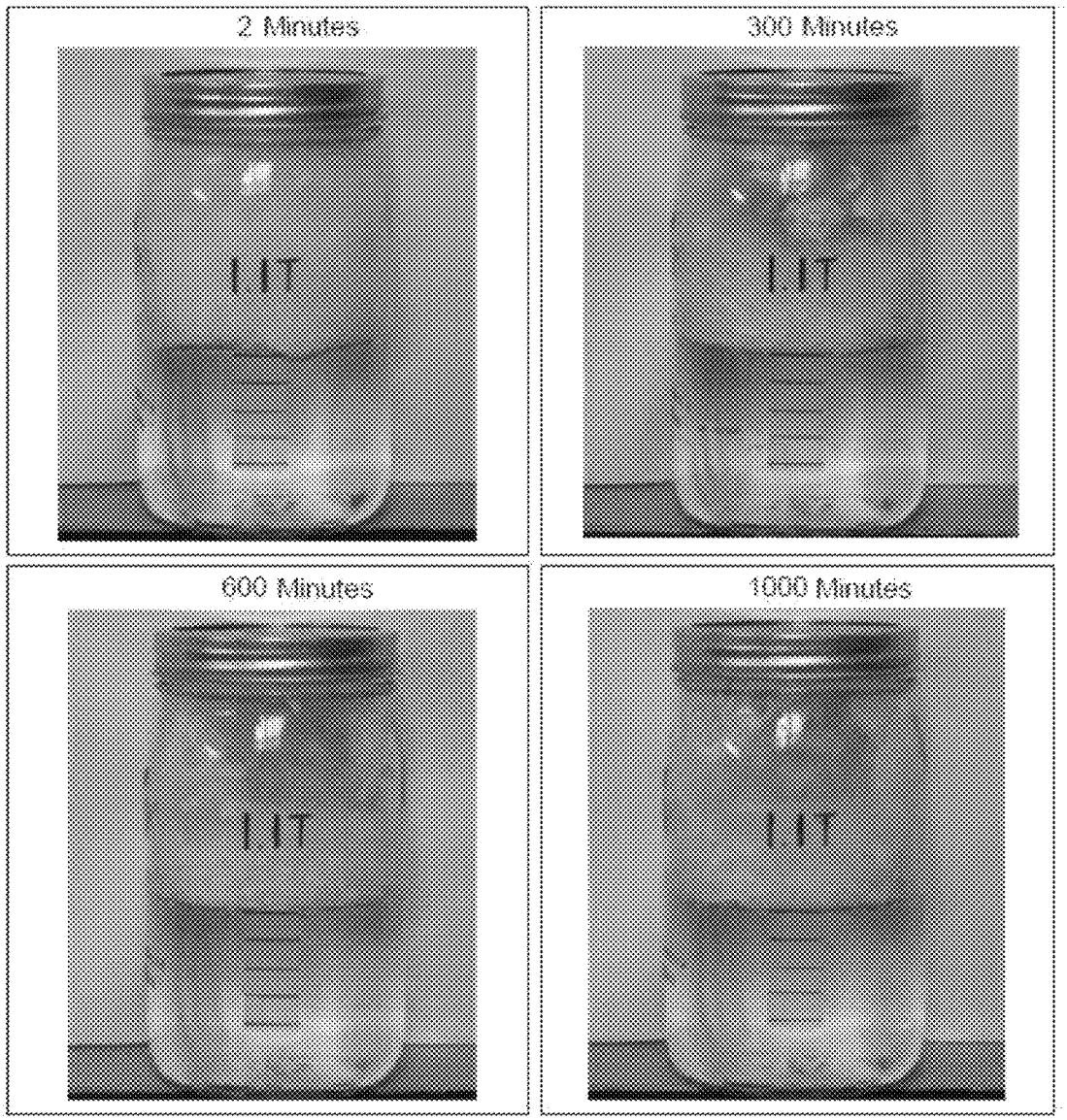

[FIG. 6]
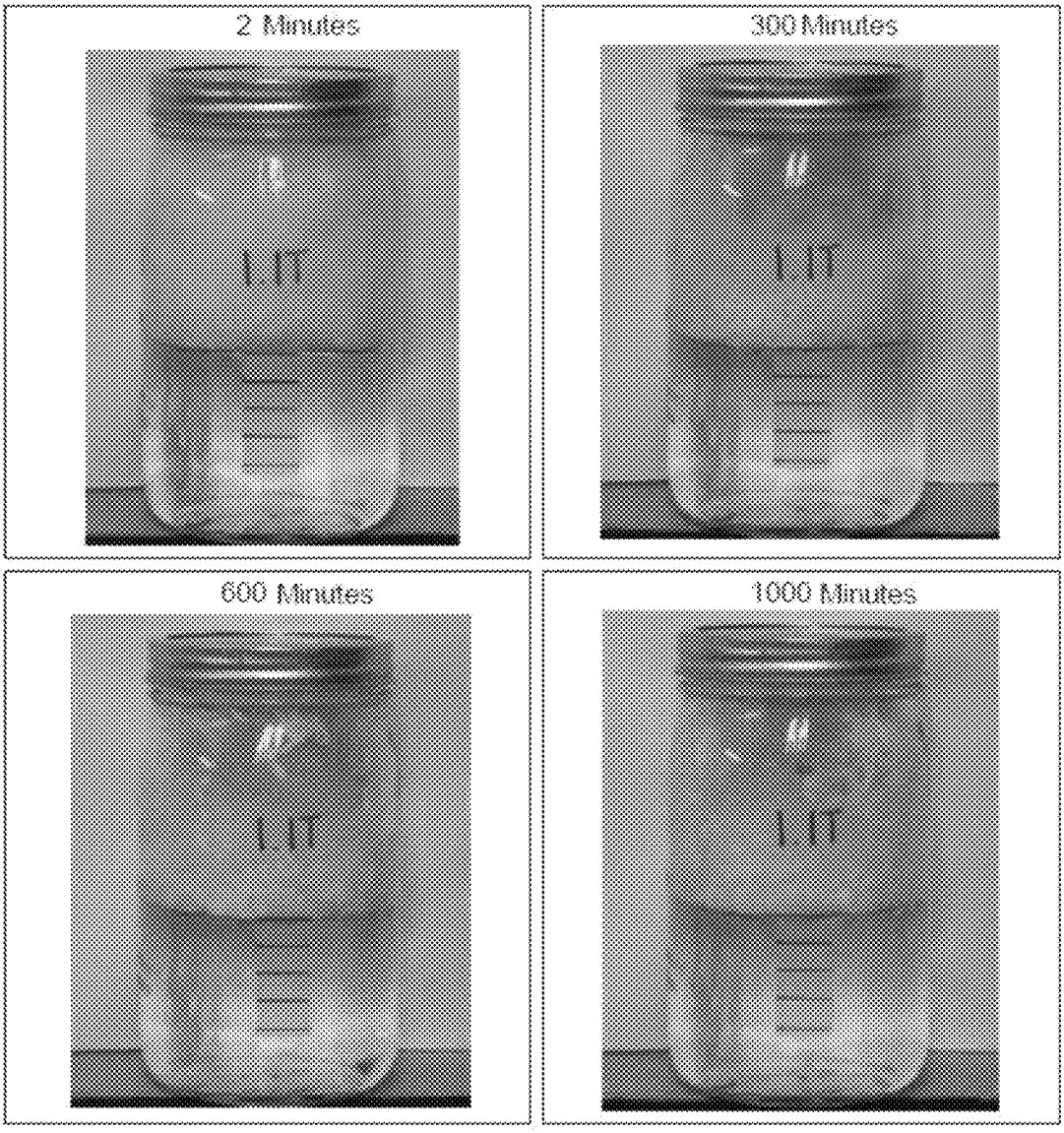

WATER-REPELLENT FABRIC AND WATER-REPELLENT DOWN PRODUCT COMPRISING THE SAME

TECHNICAL FIELD

The present invention relates to a water-repellent fabric and a water-repellent down product. More particularly, the present invention relates to a high-performance water-repellent fabric that is made of an environmentally friendly material, is excellent in water repellency, moisture permeability, and heat retainability, and has superior durability, and a water-repellent down product including the same.

BACKGROUND ART

Down, which is a collection of feathers of birds, such as those of ducks or geese, is lightweight, packable, and provides excellent thermal insulation, and thus is mainly used in padded clothes, sleeping bags, bedding, and the like. The padded clothes, sleeping bags, and bedding padded with down generally have a down filling on the inside thereof such as between the lining and the outer material or inside a down bag in such a manner that the down is covered and protected by the outer material or the down bag so as not to be exposed to moisture and easily become wet.

In particular, lightweight down garments are widely and variously used as outdoor garments and activewear worn for mountain climbing, skiing, golfing, hiking, jogging, and the like, since they do not restrict movement, are easy to carry around, and provide comfort to the wearer through thermal insulation.

However, despite being perceived as expensive high-performance outdoor products, down garments are vulnerable to moisture such as sweat and water vapor and easily wetted by snow or rain when worn for outdoor activities. Once wet, the down clothing not only easily loses its heat retainability, in which case the wearer is exposed to the risk of hypothermia, but also requires a long time to dry. Therefore, it is essential to complement the functionality of the fabric or down being used by imparting water repellency to the same.

However, even conventional down clothing, sleeping bags, and the like which have been imparted with general water-resistant properties have drawbacks in that their functional properties such as heat retainability and water repellency are rapidly degraded due to repeated washing, and the wearer's sweat and body odor accumulate in the down itself during long-term use to intensify the unwanted odor to regular down or lead to bacterial and other microbial growth.

In addition, in the case of a fluorinated water repellent which has been mainly used as a water repellent in existing waterproof outdoor clothing such as a Gore-Tex jacket, perfluorinated chemicals (PFCs) which are the main components of the fluorinated water repellent have been reported to have toxic effects by acting as environmental hormones, and European countries have strengthened regulations on fluorinated water repellents such as PFOA (perfluorooctanoic acid, C8) and PFOS (potassium perfluorooctane sulfonate, C6), and therefore, a growing number of attempts have been made to use a non-fluorinated water repellent not containing any PFCs as a water repellent for a down product. However, when applied to a fabric by the same process as for a conventional fluorinated water repellent, such a non-fluorinated water repellent which does not contain PFCs (CO type) has a problem in that it contaminates the fabric by causing stains, or the fabric does not exhibit a sufficient level of initial and sustained water repellency.

Therefore, there is a need to develop a water-repellent down product which, despite being produced using an environmentally-friendly CO-type non-fluorinated water repellent, exhibits excellent water repellency and excellent heat retainability, and does not lose water repellency and heat retainability even by repeated washing.

DISCLOSURE

Technical Problem

The present invention has been made considering the above-described problems, and is directed to providing: a water-repellent fabric and water-repellent down which are harmless to the human body and the environment and thus are environmentally friendly, and exhibit excellent water repellency, excellent heat retainability, and improved durability after washes; and a water-repellent down product, such as a garment, a sleeping bag, and bedding, which is made of the same.

Technical Solution

In order to solve the above-mentioned problems, in one aspect of the present invention, there is provided a method of preparing a water-repellent and moisture-permeable fabric, which includes: immersing a fabric in a non-fluorinated water-repellent emulsion containing a non-fluorinated water repellent and an aqueous blocked polyisocyanate crosslinking agent; applying, to a water-repellent fabric prepared by subjecting the fabric, which has been immersed, to drying and curing at a temperature of 150° C. to 200° C., a polyurethane-based moisture-permeable coating liquid; and drying the water-repellent fabric while increasing a temperature from 100° C. to 150° C., wherein the method is characterized in that the water-repellent and moisture-permeable fabric retains a water repellency level of at least 4 after 20 washes, and that the moisture-permeable coating liquid realizes a water vapor permeability of at least 40,000 $g/m^2/24$ h as determined by HS L 1099:2012, Method B-1 (Potassium acetate test) when applied to a fabric and dried while increasing a temperature from 100° C. to 150° C. to prepare a microporous moisture-permeable fabric.

In the present invention, the above-described water-repellent and moisture-permeable fabric may have a water vapor permeability of at least 10,000 $g/m^2/24$ h as determined by HS L 1099:2012, Method B-1 (Potassium acetate test).

In the present invention, the above-described fabric may be selected from the group consisting of polyester, polyamide, polyvinyl chloride, polyketone, polysulfone, polycarbonate, polyacrylate, polyurethane, polypropylene, nylon, and Spandex polyurethane.

In the present invention, the above-described non-fluorinated water repellent may contain a polymer having a unit represented by the following Chemical Formula 1, an organic solvent, and water:

[Chemical Formula 1]

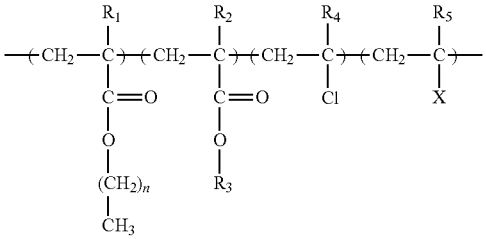

(wherein in Chemical Formula 1, n is an integer of 1 to 30, $R_1$ to $R_5$ each independently represent an alkyl group having 1 to 21 carbon atoms, and X is a hydrogen atom, an alkyl group having 1 to 21 carbon atoms, or a halogen atom.)

In the present invention, the above-described non-fluorinated water-repellent emulsion may contain a non-fluorinated water repellent and a crosslinking agent in an amount of 5 parts by weight to 10 parts by weight of and 0.5 part by weight to 5 parts by weight, respectively, with respect to 100 parts by weight of the entire non-fluorinated water-repellent emulsion.

In another aspect of the present invention, there is provided a water-repellent and moisture-permeable fabric prepared by the above-described method.

In still another aspect of the present invention, there is provided a water-repellent down product which includes the above-described water-repellent and moisture-permeable fabric and water-repellent down.

In the present invention, the water-repellent down product may be selected from the group consisting of a water-repellent down garment, a water-repellent down sleeping bag, water-repellent down bedding, and other water-repellent down goods.

Advantageous Effects

The water-repellent and moisture-permeable fabric and the water-repellent down product according to the present invention exhibit the following functions and advantageous effects despite being produced without using any fluorinated chemicals (PFCs) reported as acting as environmental hormones and being harmful to the human body: the same can provide excellent water repellency and excellent heat retainability; the water repellency is not degraded but maintained even after multiple repeated washes; and the water repellency can be restored by heating.

In addition, since a breathable, moisture-permeable coating is provided on a fabric, a phenomenon in which the down penetrates through the fabric and is lost does not occur even with multiple repeated washes. Not only that, the microporous coated fabric transmits and allows the heat on the inside and the water vapor resulting from perspiration during outdoor activities to be discharged while not letting in water (e.g., snow and rain) and cold winds from the outside such that the wearer can enjoy various outdoor sports activities, such as mountain tracking, climbing, golfing, cycling, skiing, snowboarding, jogging, and walking, in winter without interruption while maintaining normal body temperature in any weather conditions. Moreover, the microporous coated fabric allows the down to breathe and thereby remain fresh at all times, so that the lifetime of the product is extended, the down does not give off an offensive odor or microbial activity in the down is suppressed, and the down product requires less frequent washing compared to untreated regular down product and thus provides a benefit of saving water resources, energy, and related costs.

DESCRIPTION OF DRAWINGS

FIG. 1 shows micro scopic images of a fabric after treatment with a CO-type non-fluorinated water repellent of the present invention.

FIG. 2 shows a micro scopic image of a microporous coated moisture-permeable fabric of the present invention.

FIG. 3 shows a micro scopic image of a moisture-permeable laminated fabric according to the prior art.

FIG. 4 shows the results of testing the water repellency of water-repellent down of the present invention.

FIG. 5 shows the results of testing the water repellency of water-repellent down of the present invention after 5 washes.

FIG. 6 shows the results of testing the water repellency of water-resistant down of the present invention after 10 washes.

BEST MODE

Hereinafter, embodiments of the present invention will be described in detail with reference to the accompanying drawings. The following description is provided only to promote understanding of embodiments of the present invention, and is not intended to limit the scope of the invention thereto.

1. Fabric

The present invention relates to a water-repellent fabric and a water-repellent down product, wherein the water-repellent down product of the present invention includes garments, sleeping bags, bedding, and the other types of water-repellent down goods. The water-repellent fabric of the present invention may be used in outdoor garments, such as down jackets, innerwear, and pants; outdoor goods, such as hats, backpacks, sleeping bags, and tents; or shoes, but the present invention is not limited thereto.

The fabric to be used in the water-repellent down product of the present invention is a product made of fiber yarns, examples of which include woven fabrics, knitted fabrics, felted fabrics, and the like. In particular, the fabric to be used in the present invention is a type that may be suitably applied to various outdoor wear and various active sportswear such as those worn for mountain climbing, skiing, golfing, hiking, and jogging.

Such a fabric may be made of a synthetic fiber such as a nylon fiber, a polyester fiber, and a Spandex polyurethane fiber. For example, the fabric may be one or more selected among polyester, polyamide, polyvinyl chloride, polyketone, polysulfone, polycarbonate, polyacrylate, polyurethane, and polypropylene.

In the present invention, the fabric may be dyed with a dye of a desired color prior to being subjected to the water-repellent coating and moisture-permeable coating processes to be described below. The dyeing may be carried out using a dye and a process generally used in the art. For example, the dyeing may be carried out by immersing a fabric in a dye and drying the same at 150° C. to 200° C. by applying heat.

2. Production of Water-Repellent Fabric

The water-repellent fabric of the present invention may be produced by applying a water-repellent coating to one side of the above-described fabric. It is preferable that the one side of the fabric to which the water-repellent coating is to be applied is the side to be directly exposed to the external environment, for example, the outer surface of a water-repellent down garment.

The water-repellent coating agent used in the present invention is a CO-type non-fluorinated water repellent not containing PFCs, such as PFOA and PFOS, the use of which is controversial and regulated for environmental reasons. In the present invention, the term "CO-type" is used to refer to a type of water repellent which does not contain fluorine (or $CF_2$) as a water-repellent component.

The non-fluorinated water repellent which may be used in the present invention may contain a polymer having a unit represented by the following Chemical Formula 1, an organic solvent, and water.

[Chemical Formula 1]

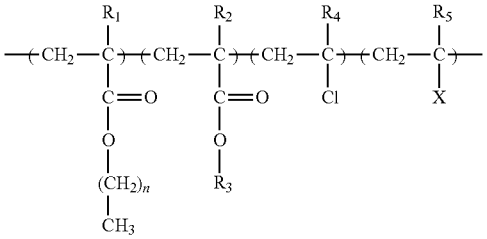

(wherein in Chemical Formula 1, n is an integer of 1 to 30, $R_1$ to $R_5$ each independently represent an alkyl group having 1 to 21 carbon atoms, and X is a hydrogen atom, an alkyl group having 1 to 21 carbon atoms, or a halogen atom.)

In the non-fluorinated water repellent of the present invention, the polymer having a unit represented by Chemical Formula 1 may be contained in an amount of 10 wt % to 30 wt %, preferably 15 wt % to 25 wt %, and most preferably about 18 wt %.

In the non-fluorinated water repellent of the present invention, the organic solvent may be one or more selected among acetone, methyl ethyl ketone, ethyl acetate, propylene glycol, dipropylene glycol monomethyl ether, dipropylene glycol, tripropylene glycol, and ethanol, and is preferably tripropylene glycol. In the non-fluorinated water repellent of the present invention, the organic solvent may be contained in an amount of 1 wt % to 15 wt %, preferably 3 wt % to 8 wt %, and most preferably about 5 wt %.

The non-fluorinated water repellent may further contain an additive such as an emulsifier as necessary, and may contain water as the remainder. In the non-fluorinated water repellent, water may be contained in an amount of 55 wt % to 85 wt %, preferably 65 wt % to 80 wt %, and most preferably about 77 wt %. The water repellent may have a pH of 2.0 to 7.0.

FIGS. 1A and 1B are micro scopic images of a fabric after treatment with a CO-type non-fluorinated water repellent of the present invention. Since the CO-type non-fluorinated water repellent of the present invention can implement coating on a nanometer scale, it can artificially form fine particle-like protrusions resembling lotus leaves on the surface of each yarn constituting the fabric, and since the surface of the yarns includes nanometer-scale modifications in the form of multiple layers of superimposed nanoparticles, not only an excellent antifouling effect is exhibited, but also a self-purification effect is exhibited.

In the present invention, it is preferable that the non-fluorinated water repellent and a crosslinking agent are applied together to a fabric.

In the present invention, the crosslinking agent may be an isocyanate-based crosslinking agent. Here, the isocyanate-based crosslinking agent may be an aliphatic and/or aromatic isocyanate generally known in the art. A representative aliphatic isocyanate is hexamethylene diisocyanate (HDI). Examples of widely-known aromatic isocyanates in the art include toluene-2,4-diisocyanate (TDI) and methylene diphenyl diisocyanate (MDI). In the case of TDI and MDI, among those described above, two or more isocyanate functional groups may be linked to toluene or a benzene ring at any arbitrary substitution position. Other examples of a generally-known isocyanate-based crosslinking agent include polymeric MDIs.

Particularly preferably, the isocyanate-based crosslinking agent is a blocked isocyanate. The blocked isocyanate refers to an aliphatic or alicyclic diisocyanate in which one or more —NCO functional groups (i.e., active substituent) have been transformed into NC(═O)—OR by reacting with an alcohol (ROH). Here, the alcohol may be a monohydric alcohol or a polyhydric alcohol. The blocked isocyanate obtained by the above-described transformation and having a functional group resulting from the transformation at room temperature is thermally dissociable in that it dissociates back into an isocyanate and an alcohol at an elevated temperature, in which case, the isocyanate produced by the dissociation functions as a crosslinking agent. Such dissociation typically takes place at a temperature of 90° C. to 160° C. In a particular embodiment of the present invention, the most preferred isocyanate-based crosslinking agent is an aqueous blocked polyisocyanate.

The above-described non-fluorinated water repellent and the above-described crosslinking agent may be contained in an amount of 5 parts by weight to 10 parts by weight and 0.5 part by weight to 5 parts by weight, respectively, with respect to 100 parts by weight of the entire non-fluorinated water-repellent emulsion, and it is preferred that the non-fluorinated water repellent and the crosslinking agent are contained in an amount of about 7 parts by weight and about 1 part by weight, respectively. When the crosslinking agent is contained in an amount of less than 0.5 part by weight, sufficient bonding between the fabric material and the water repellent is not provided such that the resulting fabric exhibits relatively low washing durability. On the other hand, when the crosslinking agent is contained in an amount of greater than 5 parts by weight, components of the composition form an excessive amount of bonds with the fabric to such an extent that the fabric loses its stretchability and becomes unsuitable as a material for outdoor garments.

Although the non-fluorinated water-repellent emulsion may contain an additive such as a softener, an antistatic agent, or an antibacterial agent in addition to the non-fluorinated water repellent and the crosslinking agent, it is preferable that no additional additive is used so that optimal water repellency can be exhibited.

Hereinafter, the process of applying a water-repellent coating to a fabric will be described in detail.

In the present invention, the method of coating a fabric with the above-described non-fluorinated water repellent includes:

immersing a fabric in a non-fluorinated water-repellent emulsion; and subjecting the fabric, which has been immersed in the water-repellent emulsion, to drying and curing at a temperature of 150° C. to 200° C.

Unlike in the case of coating a fabric with a conventional fluorinated water repellent where three to five cycles of drying and curing are required, in the case of a CO-type non-fluorinated water repellent, it has been found that three to five cycles of drying/curing cause the staining of the fabric and unexpectedly result in a reduction in water repellency. The coating process according to the present invention has been developed based on the optimization of coating process conditions for a CO-type non-fluorinated water repellent, so that a water-repellent coating exhibiting excellent water repellency and excellent durability can be obtained even by a single cycle of the coating process.

The above-described stage of immersing a fabric in a non-fluorinated water-repellent emulsion may be carried out by filling a bath with a non-fluorinated water-repellent emulsion containing a non-fluorinated water repellent and a crosslinking agent, putting a fabric into the emulsion such that the fabric is completely immersed in the emulsion, and removing the fabric from the emulsion. Here, the fabric may be conveyed in a roll-to-roll manner, wherein the conveying speed is preferably 50 m/min to 70 m/min, more preferably 55 m/min to 65 m/min, and most preferably about 60 m/min.

After the immersion in a non-fluorinated water-repellent emulsion, the fabric may be subjected to drying and curing so that a volatile solvent is evaporated and a water-repellent component is fixed on the fabric. The drying and curing is performed preferably at a temperature of 150° C. to 200° C., more preferably at a temperature of 160° C. to 180° C., and most preferably at a temperature of about 170° C. Likewise, the drying may be performed while the fabric is being conveyed in a roll-to-roll manner, wherein the conveying speed is preferably 50 m/min to 70 m/min, more preferably 55 m/min to 65 m/min, and most preferably about 60 m/min.

A water-repellent fabric prepared using a non-fluorinated water repellent of the present invention maintains excellent water repellency even after multiple washing. Specifically, the water-repellent fabric of the present invention maintains a water repellency level of at least 4 even after 20 to 25 washes, a water repellency level of 3 after 30 washes, and a water repellency level of 2 or 3 after 40 washes, wherein the water repellency level is determined in accordance with KS K 0590:2008 (Spray test).

Five water repellency levels are officially assigned based on the above-described test, wherein level 5 denotes that 100% water repellency is maintained after washing, level 4 denotes that 90% water repellency is maintained after washing, level 3 denotes that 80% water repellency is maintained after washing, level 2 denotes that 70% water repellency is maintained after washing, and level 1 denotes that at most 60% water repellency is maintained after washing. Conventionally, U.S. exports require that 70% water repellency be maintained after 10 washes.

The above-described result demonstrates outstanding performance considering the fact that the use of a conventional fluorinated water repellent generally results in level 3 or level 2 after 10 washes. Many famous international apparel brands advertise that their products exhibit excellent water repellency after washing, but test reports which they actually submitted show a water repellency level of 3 or 2 after 10 to 20 washes.

Further, according to the process of the present invention, it is possible to enhance hyper durability of fabric because a water repellent realizes a nanometer-scale coating at the yarn level constituting the fabric, and furthermore, the water repellency once damaged due to friction during long-term use or due to multiple repeated washes can be restored by heating. Specifically, when a specific part of the nanometer-scale multi-layered coated structure realized at the yarn level is damaged due to friction, repeated washing, or the like, it can be restored to a considerable extent by heating which allows the disordered molecular arrangement to be rearranged, and therefore, excellent durability can be exhibited, and excellent water repellency can be maintained. In one exemplary embodiment of the present invention, there was even a case of increased water repellency when ironing after 20 washes and five subsequent washes were added In addition, since a non-fluorinated water repellent is used, it is harmless to the human body and the environment and does not generate any environmental hormones and thus is environmentally friendly.

3. Moisture-Permeable Coating

It is preferable that the water-repellent fabric of the present invention further includes a moisture-permeable coating and is a water-repellent and moisture-permeable fabric.

In the water-repellent fabric of the present invention, the surface to be exposed to the external environment is water-repellent coated with a non-fluorinated water repellent, and the surface on which the down will be located is moisture-permeable coated. Therefore, a phenomenon in which the down penetrates through the fabric and is lost has been prevented in advance and does not occur even with multiple repeated washes. In addition, the fabric prevents water such as snow and rain from penetrating from the outside and, at the same time, allows interior sweat and water vapor generated from the human body during outdoor activities to be discharged to the outside; therefore, the down can always remain fresh and dry, an odor is not developed because bacterial growth is suppressed, and the lifetime of the product can be extended.

In the present invention, the moisture-permeable coating is formed by applying a moisture-permeable coating liquid onto a fabric. In the present invention, the moisture-permeable coating liquid is preferably a polyurethane-based coating liquid. Specifically, the moisture-permeable coating liquid may have a form in which a polyurethane-based resin is mixed with one or more of a solvent, an anti-skinning agent, a crosslinking agent, a silicone resin, a defoaming agent, a water repellent, and a pigment in a dilution solvent composed of water and an organic solvent.

In the present invention, the polyurethane-based resin may include a polyurethane polyol and an aromatic diisocyanate.

In the present invention, the organic solvent may be one or more selected among acetone, methyl ethyl ketone, toluene, ethyl acetate, propylene glycol, dipropylene glycol monomethyl ether, dipropylene glycol, tripropylene glycol, and ethanol, and is most preferably methyl ethyl ketone.

In the present invention, the solvent, the anti-skinning agent, the crosslinking agent, the silicone resin, the defoaming agent, the water repellent, and the pigment may be those generally used in the art.

In one embodiment of the present invention, the moisture-permeable coating process includes applying the moisture-permeable coating liquid to one side of a fabric and carrying out multi-stage drying while increasing a temperature from 100° C. to 150° C. Since the drying is carried out while increasing the temperature as described above, it is carried out as multi-stage drying of the dilution solvent (i.e., a mixture of water and an organic solvent) in which the organic solvent is primarily evaporated and the water is subsequently evaporated, and the moisture-permeable coating method causes to form micro-pores in the portions from which the water has been removed.

Since the moisture-permeable coating method forming the above-described micro-porous structure allows sweat to be discharged to the outside while it is in a vapor state and has not yet formed a droplet, it is possible to provide a much more comfortable environment for a down product compared to the prior art.

Here, the formation of pores depends on the content of water in the dilution solvent which is a mixture of water and an organic solvent, wherein the formation of a number of pores leads to a decrease in internal water pressure, a decrease in tensile strength, and a relative increase in moisture permeability, whereas the formation of a small number of pores produces an opposite effect. Therefore, an appropriate content of water is an important factor for obtaining optimal physical properties. Considering this point, it is preferable that the content of water in the dilution solvent which is a mixture of water and an organic solvent be 20 parts by weight to 50 parts by weight with respect to 100 parts by weight of the polyurethane-based resin. When the content of water is less than 20 parts by weight, moisture permeability is remarkably decreased. On the other hand, although an increase in the content of water leads to a reduction in internal water pressure and in tensile strength and an increase in moisture permeability, when the content of water is greater than 50 parts by weight, viscosity is increased to such an extent that it is not suitable for coating.

Since the water-repellent and moisture-permeable fabric of the present invention is prepared by directly applying a polyurethane-based moisture-permeable coating liquid on a fabric and drying the same while increasing a temperature, it is a one-layer fabric, excellent in both water repellency and moisture permeability, and in particular, it has excellent moisture permeability, is lightweight, and is less likely to undergo separation of the moisture-permeable coating.

FIG. 2 shows a micro-camera image of a moisture-permeable fabric of the present invention. As can be seen in FIG. 2, since the moisture-permeable fabric of the present invention is formed by applying a moisture-permeable coating liquid directly onto a fabric, the resulting moisture-permeable polyurethane coating layer is integrated with the yarn. Due to the structural characteristic that the water-repellent coating layer has penetrated into and is integrated with the inside of the fabric, the water-repellent layer is not easily separated, and since the inclusion of components such as an adhesive layer is omitted, the resulting fabric is very lightweight and exhibits outstanding water vapor permeability.

The above-described method of forming a moisture-permeable coating is differentiated from a conventional technique in which a moisture-permeable film is formed on a silicone release paper, removed from the silicone release paper, and laminated onto a fabric using an adhesive layer, resulting in a fabric consisting of two or more layers.

FIG. 3 shows a moisture-permeable laminated layer prepared according to a conventional method. In FIG. 3, it can be confirmed that an adhesive layer has been formed between a raw fabric and the moisture-permeable film layer, forming a laminate. The inclusion of an adhesive layer between a fabric and a moisture-permeable film results in relatively low water vapor permeability because the adhesive layer interferes with the permeation of water vapor. Not only that, the resulting fabric is heavy, and the moisture-permeable layer is easily peeled off due to an external impact such as repeated washing.

Therefore, a moisture-permeable coating formed by the process of the present invention exhibits far superior moisture permeability than a moisture-permeable laminate layer according to the prior art. The physical properties of a moisture-permeable coating formed by the process of the present invention will be described, and a separate description will be given for a moisture-permeable coating formed on a common fabric and a moisture-permeable coating formed on a water-repellent fabric.

For a moisture-permeable coating of the present invention formed on a common fabric, an air permeability of 2 CFM (cubic feet per minute) or more is preferable, and an air permeability of 3 CFM or more is more preferable. When the air permeability is too low such that it does not allow the down to breathe, the down's ability to maintain integrity and ability to recover after washing are reduced, and thus the lifetime (heat retainability) of the down product is shortened.

In addition, the above-described moisture-permeable coating formed on a common fabric has a water vapor permeability of 5,000 $g/m^2/24$ h or more, preferably 7,000 $g/m^2/24$ h or more, and most preferably 9,000 $g/m^2/24$ h or more, as determined by JIS L 1099:2012 (Calcium chloride test), and has a water vapor permeability of 35,000 $g/m^2/24$ h or more, preferably 40,000 $g/m^2/24$ h or more, and most preferably 44,000 $g/m^2/24$ h or more, as determined by JIS L 1099:2012, Method B-1 (Potassium acetate test). When the water vapor permeability is below the above-described ranges such that sweat is not easily discharged, there is a high possibility that an offensive odor is generated and bacteria grow in the down.

In addition, when a moisture-permeable coating of the present invention is applied to a water-repellent fabric of the present invention, the resulting water-repellent and moisture-permeable fabric exhibits outstanding moisture permeability characterized by a water vapor permeability of 9,000 $g/m^2/24$ h or more as determined by JIS L 1099:2012 (Calcium chloride test) and a water vapor permeability of 10,000 $g/m^2/24$ h or more as determined by JIS L 1099: 2012, Method B-1 (Potassium acetate test).

Since the water-repellent and moisture-permeable fabric of the present invention includes a water-repellent coating on one side and a moisture-permeable coating on the other side such that it allows the water vapor on the inside generated by perspiration to be discharged while providing protection from moisture on the outside, such as rain or snow, it can provide maintained water repellency and heat retainability, and maintain long-term durability.

The water-repellent fabric of the present invention may be used in outdoor garments, such as down jackets, innerwear, and pants; outdoor goods, such as hats, backpacks, sleeping bags, and tents; or shoes, but the present invention is not limited thereto.

4. Water-Repellent Down Product

In one aspect of the present invention, there is provided a water-repellent down product which includes the above-described water-repellent fabric and water-resistant down. The above-described water-repellent down product includes garments, sleeping bags, bedding, and the other types of water-repellent down goods. Here, the above-described water-repellent down garments may include down jackets, innerwear, pants, and the like. The above-described water-repellent down goods include hats, backpacks, tents, shoes, and the like.

The water-repellent down product is produced using a water-repellent fabric of the present invention and includes water resistant down on the inside thereof. Down, which is a collection of feathers of birds, such as those of ducks or geese, is lightweight, packable, and provides excellent thermal insulation, and thus is suitable for use in outdoor garments and the like. Since down is easily wetted by moisture and loses thermal insulation properties, it is preferable to impart water repellency also to down before use in garments.

In a water-repellent down product of the present invention, it is preferable to use water resistant down which is down coated with a water repellent on the nanomolecular scale and exhibiting maintained water repellency for 600 minutes or more and preferably for 1,000 minutes or more before washing. Further, it is more preferable to use water resistant down which exhibits maintained water repellency for 300 minutes or more and preferably for 1,000 minutes or more even after 10 washes.

Processing of down generally proceeds in the order of dedusting, washing, drying, cooling, and sorting. In the processing of down according to the present invention, a water-repellent coating solution is sprayed in the drying process so that a nanometer-scale water-repellent coating is applied to down, which results in a water-resistant down which does not get wet. It is preferable that the water-repellent coating solution be a non-fluorinated water repellent, although there is no particular limitation as long as it is a water-repellent coating solution capable of providing the above-described effects. In one embodiment of the present invention, the above-described non-fluorinated water-repellent emulsion, which includes a CO-type non-fluorinated water repellent, may be used to apply a water-repellent coating to down.

The down to which the above-described water-repellent coating has been applied exhibits at least 30- to 40-fold improved water resistance (hydrophobicity) compared to an existing common, untreated down, and when compared to down treated by a conventional water-repellent coating technique, it consumes 25 times less water, and dries three to four times faster when partially wet. In addition, it does not require use of a fluorinated water repellent such as those based on PFOA and PFOS, and thus is harmless to the human body and the environment. Therefore, the water-resistant down is not easily wetted by the external environment such as snow or rain and dries quickly after washing such that it can maintain fluffiness and heat retainability, and the generation of bacteria and viruses caused by perspiration or moisture can be suppressed.

EXAMPLES

Example 1: Water Repellency Evaluation of Water-Repellent Fabric

A water-repellent emulsion was prepared by introducing a 1:1 mixture (w/w) of water and ethanol into an immersion bath and then mixing it with a CO-type non-fluorinated water repellent (XF-5001 manufactured by Daikin Industries, Ltd.) and a blocked polyisocyanate-based crosslinking agent (TDX-7 manufactured by Daikin Industries, Ltd.) which were introduced in an amount of 7 wt % and 1 wt %, respectively, based on the total amount of the water and the ethanol.

A polyester fabric (FDX390 manufactured by Onechang Material Co. Ltd.) was introduced into the prepared water-repellent emulsion at a conveying speed of 60 m/min by a roll-to-roll process such that the fabric was completely immersed in the emulsion. After being removed from the emulsion, the fabric was dried and cured at 170° C.

A water-repellent fabric prepared as such was tested in accordance with KS K 0590:2008 (Spray test) to determine the water repellency level thereof. The test results are shown in the following Table 1.

TABLE 1

| Repeated washes | 20 | 25 | 30 | 40 | Comments |
|---|---|---|---|---|---|
| Experiment 1 | Level 4 | Level 4 | Level 3 | Level 2 | |
| Experiment 2 | Level 4 | Level 5 | Level 4 | Level 3 | 20 washes followed by heat treatment |

As can be seen from Table 1, the water-repellent fabric of the present invention exhibited a water repellency level of 4 after 20 washes, of 4 after 25 washes, of 3 after 30 washes, and of 2 after 40 washes.

The above-described result demonstrates outstanding performance considering the fact that the use of a conventional fluorinated water repellent generally results in level 3 or level 2 after 10 washes.

Moreover, when heat treatment by ironing was performed after 20 washes and a water repellency level was determined upon the 20 washes, there was even a case of increased water repellency after a total of 25 washes. That is, it can be seen that the water repellency of a water-repellent fabric of the present invention can be restored or improved to a certain level by heat treatment.

Example 2: Performance Evaluation of Moisture-Permeable Coating

A moisture-permeable coating liquid having a viscosity of about 20,000 cps at 25° C. was prepared by mixing a dry porous polyurethane coating (V-coat 2000sp manufactured by Duek-keum. Co. Ltd.) with a methyl ethyl ketone solvent to a solid content of about 30%.

The moisture-permeable coating liquid was applied onto a polyester fabric conveyed by a roll-to-roll process to a thickness of 40 μm, and then the fabric was passed, at a conveying speed of 15 m/min, through a high-temperature region of a drying chamber where the temperature was gradually increased from 100° C. to 150° C.

When the moisture-permeable coating was completed, the resulting fabric was tested in accordance with JIS L 1096: 2010, 8.26.1 to determine the air permeability thereof. The determined air permeability was 4.0 CFM.

The same fabric was tested in accordance with JIS L 1099:2012 (Calcium chloride test) to determine the water vapor permeability thereof. The determined water vapor permeability was very high: 9,900 $g/m^2/24$ h.

The water vapor permeability of the same fabric was also determined in accordance with JIS L 1099:2012, Method B-1 (Potassium acetate test). The determined water vapor permeability was 44,500 $g/m^2/24$ h.

It can be seen from the above-described results that the fabric of the present invention, to which a moisture-permeable coating has been applied, has a range of air permeability and water vapor permeability which allows the air to easily pass through the fabric such that the down can breathe and allows sweat generated on the inside to be easily discharged to the outside.

Example 3: Moisture-Permeability Evaluation of Water-Repellent and Moisture-Permeable Fabric A water-repellent and moisture-permeable fabric was prepared by applying, to a fabric which is a water-repellent fabric prepared in Example 1, a moisture-permeable coating by the method described in Example 2.

The resulting water-repellent and moisture-permeable fabric was tested in accordance with JIS L 1099:2012 (Calcium chloride test) to determine the water vapor permeability thereof. The determined water vapor permeability was very high: 9,442 $g/m^2/24$ h.

The water vapor permeability of the same fabric was also determined in accordance with JIS L 1099:2012, Method B-1 (Potassium acetate test). The determined water vapor permeability was 10,067 $g/m^2/24$ h.

The above-described results demonstrate outstanding moisture permeability considering the fact that the determined values are at least 2-fold greater than the water vapor permeability of existing laminated fabrics, which is generally about 5,000 $g/m^2/24$ h.

It can be seen from the above-described results that the water-repellent and moisture-permeable fabric of the present invention exhibits far superior water repellency and moisture permeability than a water-repellent or moisture-permeable fabric of the prior art, and that the coated fabric has a range of air permeability and water vapor permeability which allows the air to easily pass through the fabric such that the down can breathe and allows sweat generated on the inside to be easily discharged to the outside.

Example 4: Water Repellency Evaluation of Down

In order to evaluate the water repellency of water-repellent down of the present invention, water-repellent down was prepared based on 10 g of down purchased from Pan-Pacific Co., Ltd., by spraying the non-fluorinated water-repellent emulsion prepared in Example 1 into the air so that the water repellent forms a nanometer-scale coating on the down, and drying the same.

Of the prepared water-repellent down, 3 g was subjected to five washes, and another 3 g was subjected to 10 washes.

Four hundred milliliters of distilled water of about 20° C. was introduced into each of three mason jars having a volume of one liter and a height of 173 mm. On the front surface of each jar, a tape having five level-indicating marks at an interval of 1 cm was attached such that the first mark was aligned with the water surface. Thereafter, 2 g of each one of water-repellent down before washing, water-repellent down after five washes, and water-repellent down after 10 washes was introduced into each jar, and the jars were sealed by tightly closing a lid.

A sealed mason jar was placed in a horizontal-type vibrator, and was subjected to vibration for two minutes at a vibration width of 40 mm and a frequency of 150 vibrations/minute. The jar was laid on its side so that the vibration was applied in the direction of the bottom of the jar toward the opening of the jar.

After two minutes of vibration, the jar was placed on a flat floor, and was visually inspected for the position of the bottom-most part of the down with respect to the marks. One hour later, another two-minute vibration was performed, and then the position of the bottom part of the down was determined. This experiment was repeated until 1,000 minutes. FIGS. 4 to 6 show the three jars at 2 minutes, 300 minutes, 600 minutes, and 1,000 minutes after the initiation of the experiment.

As can be seen from FIGS. 4 to 6, the water-repellent down of the present invention was maintained on the water surface for 1,000 minutes in all of three conditions, which indicates that the down maintained excellent water repellency for at least 1,000 minutes even after 10 washes.

While selected exemplary embodiments of the present invention have been described above, it is to be understood that the invention is not limited only to the disclosed exemplary embodiments but can have modifications and alterations made without departing from the gist of the invention, in which case, the modifications and alterations also belong to the technical range of the invention.

The invention claimed is:

1. A method of preparing a water-repellent and moisture-permeable fabric, the method comprising:

preparing a water-repellent fabric having an external surface directly exposed to an external environment and an internal surface directly exposed to an internal material by:

immersing a raw fabric in a non-fluorinated water-repellent emulsion containing a non-fluorinated water repellent and an aqueous blocked polyisocyanate crosslinking agent; and drying and curing the raw fabric, which has been immersed, at a temperature of 150° C. to 200° C.;

applying a polyurethane-based moisture-permeable coating liquid to only the internal surface of the water-repellent fabric, wherein the water-repellent fabric is consisting of the external surface being water-repellent and the internal surface being moisture-permeable; and drying the water-repellent fabric while increasing a temperature from 100° C. to 150° C. after applying the polyurethane-based moisture-permeable coating liquid, wherein the water-repellent and moisture-permeable fabric retains a water repellency level of at least 4 after 20 washes, and the moisture-permeable coating liquid results in a moisture-permeable fabric having a water vapor permeability of 10,000 $g/m^2/24$ hours or more as determined by JIS L 1099:2012, Method B-1 (Potassium acetate test) when applied to a raw fabric and dried while increasing a temperature from 100° C. to 150° C.

2. The method of claim 1, wherein the raw fabric is selected from the group consisting of polyester, polyamide, polyvinyl chloride, polyketone, polysulfone, polycarbonate, polyacrylate, polyurethane, polypropylene, nylon, and urethane (Spandex).

3. The method of claim 1, wherein the non-fluorinated water repellent contains a polymer having a unit represented by the following Chemical Formula 1, an organic solvent, and water:

[Chemical Formula 1]

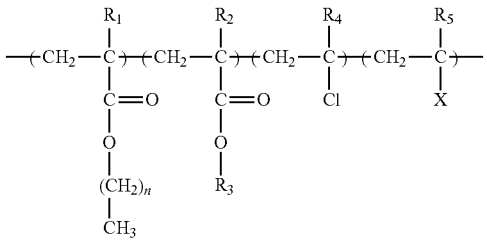

(wherein in Chemical Formula 1, n is an integer of 1 to 30, $R_1$ to $R_5$ each independently represent an alkyl group having 1 to 21 carbon atoms, and X is a hydrogen atom, an alkyl group having 1 to 21 carbon atoms, or a halogen atom).

4. The method of claim 3, wherein the non-fluorinated water-repellent emulsion contains a non-fluorinated water repellent in an amount of 5 parts by weight to 10 parts by weight and a crosslinking agent in an amount of 0.5 part by weight to 5 parts by weight with respect to 100 parts by weight of the entire non-fluorinated water-repellent emulsion.

5. The method of claim 1, wherein the polyurethane-based moisture-permeable coating liquid contains:

a polyurethane-based resin which includes a polyurethane polyol and an aromatic diisocyanate;

water; and an organic solvent.

* * * * *